US006366746B1

(12) United States Patent
Sasago et al.

(10) Patent No.: US 6,366,746 B1
(45) Date of Patent: Apr. 2, 2002

(54) DEVELOPING DEVICE AND ELECTRIC ENERGY SUPPLY PART FOR APPLYING DEVELOPING BIAS VOLTAGE

(75) Inventors: Yoshikazu Sasago; Shinya Noda; Teruhiko Sasaki; Yoshiyuki Batori; Takashi Akutsu, all of Toride; Ichiro Terada, Abiko, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/559,145

(22) Filed: Apr. 27, 2000

(30) Foreign Application Priority Data

Apr. 30, 1999 (JP) ..... 11-123648

(51) Int. Cl.[7] ..... G03G 15/00
(52) U.S. Cl. ..... 399/90
(58) Field of Search ..... 399/90, 110, 111

(56) References Cited

U.S. PATENT DOCUMENTS 5,606,722 A * 2/1997 Hart et al. ..... 399/270
5,634,175 A 5/1997 Michlin et al. ..... 399/90
5,739,900 A 4/1998 Isobe ..... 355/109
6,208,817 B1 * 3/2001 Chadani et al. ..... 399/104

FOREIGN PATENT DOCUMENTS

EP 0549400 A2 6/1993

* cited by examiner

*Primary Examiner*—Quana M. Grainger
(74) *Attorney, Agent, or Firm*—Fitzpatrick, Cella, Harper & Scinto

(57) ABSTRACT

A developing device includes a rotatable developer carrying member for carrying a developer to develop an electrostatic image formed on an image bearing member with a developer; wherein the developer carrying member includes a first cylindrical portion and a second cylindrical portion provision data an end of the first cylindrical portion and supported by bearing portion; a first electroconductive portion extended from an outside of the second cylindrical portion into an inside and electrically connected to an electroconductive portion outside the developing device with a gap from an inner surface of the second cylindrical portion; a second electroconductive portion contacted to an inner surface of the first cylindrical portion and rotatable with the first cylindrical portion and slidable on the first electroconductive portion; wherein a developing bias is applied to a first cylindrical portion through the first and second electroconductive portion from the outside electroconductive portion of the developing device.

18 Claims, 13 Drawing Sheets

DEVELOPING DEVICE AND ELECTRIC ENERGY SUPPLY PART FOR APPLYING DEVELOPING BIAS VOLTAGE

FIELD OF THE INVENTION AND RELATED ART

The present invention relates to a developing device and an electric energy supply part for applying a developing bias to a developer carrying member.

In a congressional apparatus for forming a multi-color image through an electrophotographic image formation process, a plurality of developing devices accommodating developers having different colors are provided on a rotary selecting mechanism; an electrophotographic photosensitive member(photosensitive drum) is electrically charged uniformly by a charging device and is selectively exposed to light so that electrostatic latent image is formed; and the selecting mechanism is operated so as to choose a developing roller as a developer carrying member (developing means) of a developing device accommodating a predetermined color developer (toner) to the photosensitive drum. The developing roller is rotated while being supplied with a developing bias so that electrostatic latent image on the photosensitive drum is developed into a toner image. The toner image is transferred onto a recording material, and the developing and transferring operations are repeated for the respective colors, thus providing a multi-color image.

Recently, a process cartridge containing as a unit process means such as the photosensitive drum, the developing means actable on the photosensitive drum, the charging means, cleaning means or the like has been made available.

As for a developing device or process cartridge, a proposal for a structure of an electric power supply contact of a developing bias to a developing roller (developing means) has been made wherein a flange member of an electroconductive member is provided at an end of a developing roller; an electrode in the form of a compression coil spring is mounted to the flange member for electrical conduction; an end of the compression coil spring is contacted to a contact member which is mounted to a housing of the developing device and which is electrically conducted to the electric energy supply member provided in the main assembly of the apparatus when the developing device is mounted to the main assembly of the apparatus.

As another structure of the electric power supply contact for the developing bias to the developing roller (developing means), an elastic contact portion is provided in the contact member, and the elastic contact portion is contacted to the flange member of an electroconductive member provided a an end of the developing roller.

In the case of the electric power supply contact structure, the compression coil spring is rotated integrally with the developing roller, and slides relative to the coil spring, and therefore, in general, grease is applied to the sliding portion. In the latter case of the electric power supply contact structure, the flange member is rotated integrally with the developing roller, and slides relative to the elastic contact member, and therefore, in general, electroconductive grease is applied to the sliding portion.

In addition, in the latter electric power supply contact structure, in order to stabilize the contact pressure of the sliding contact portion to the flange member of the elastic contact member, the spring constant of the elastic contact member is desirably minimized to make the degree of deformation larger. In such a case, a space is required to assure the deformation of the elastic contact member between the developing roller and the supporting frame supporting the developing roller in the developing device or the process cartridge.

SUMMARY OF THE INVENTION

The present invention is concerned with a further development of the prior-art, and it is a principal object of the present invention to provide a developing device in which a space applied by the electric power supply contact mechanism for the developer carrying member is reduced with the improved reliability of the contact portion of the electric power supply contact.

It is another object of the present invention to provide an electric energy supply part for supplying electric energy (developing bias voltage) to the developer carrying member with contact electric power supply contact for supplying electric power to the developing roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to the embodiments of the present invention in conjunction with the accompanying drawings.

In the following description, !"longitudinal direction!" of a developing device means a direction parallel to the direction of mounting-and-demounting of the developing device relative to a main assembly of an electrophotographic image forming apparatus, which is also parallel to a surface of a recording material and crossing with (substantially perpendicular to) a feeding direction of the recording material.

Referring to FIGS. 1 to 11, the description will be made as to the electrophotographic image forming apparatus according to this embodiment. (General arrangement of electrophotographic image forming apparatus)

Figure 1:
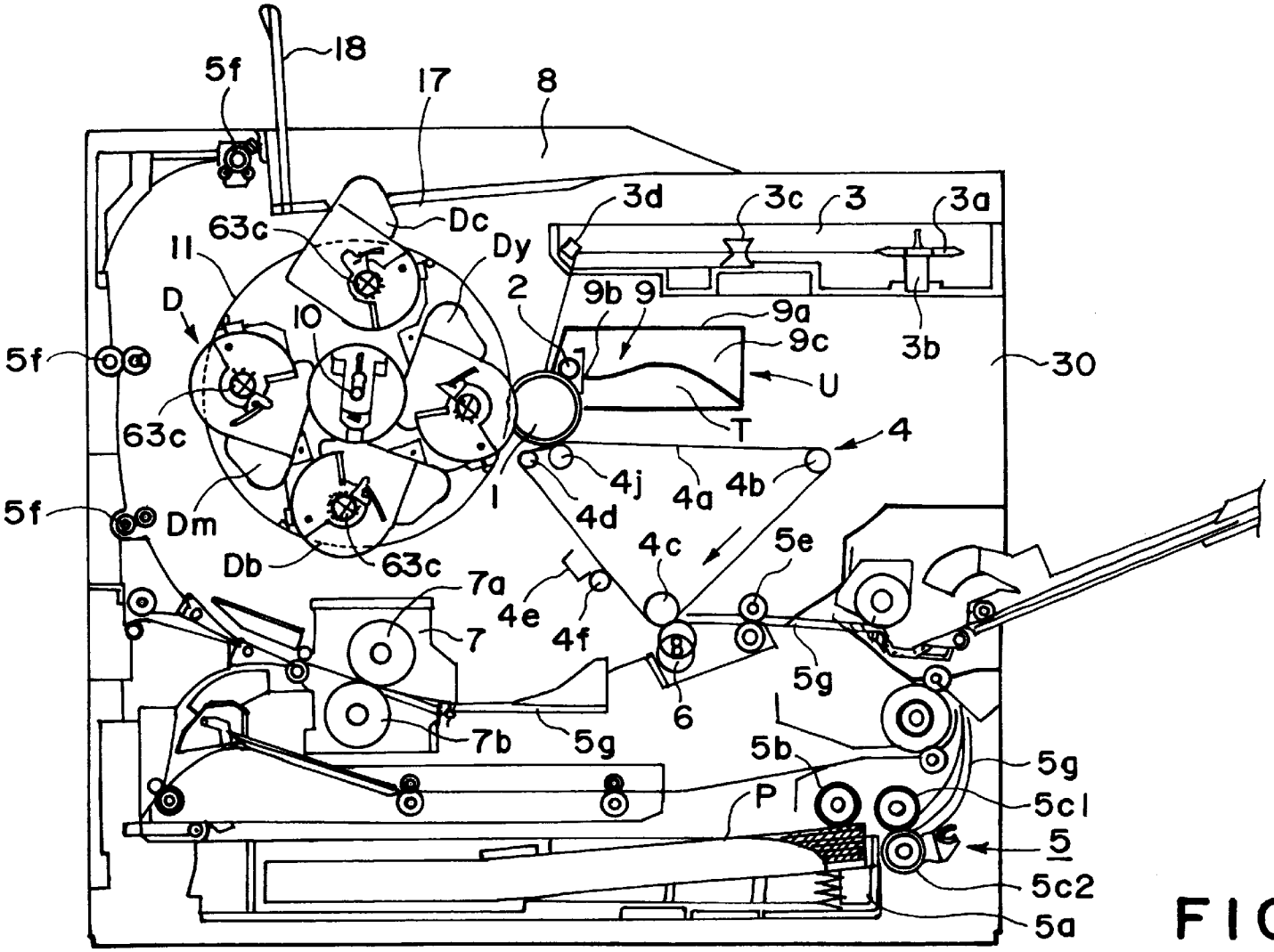
FIG. 1 is an illustration of a major part of a main assembly of a developing device and an electrophotographic image forming apparatus according to an embodiment of the present invention.

Referring to FIG. 1, the description will be made as to a general arrangement of the electrophotographic image forming apparatus in the form of a color electrophotographic image forming apparatus.

FIG. 1 shows a general arrangement of a color laser beam printer which is an example of a color electrophotographic image forming apparatus.

The color laser beam printer (electrophotographic image forming apparatus) comprises an image formation station including an electrophotographic photosensitive member 1 in the form of a drum (photosensitive drum) rotating at a constant speed, rotatable developing devices D (Dy, Dm, Dc, Db), and an intermediary transfer member 4 for carrying a color image superimposedly transferred thereonto by the image formation station and for transferring the color image onto a transfer material P (recording material) such as a recording paper, OHP sheet or the like fed from a sheet feeder by feeding means 5.

The transfer material P now having the transferred color image is fed to a fixing portion 7 where the color image is fixed on the transfer material P, and is then discharged to a discharging portion 8 provided at a top of the apparatus, by discharging rollers 5*f*. The rotatable developing devices D are individually detachably mountable to a main assembly 30 of the printer as a main assembly of the electrophotographic image forming apparatus.

The description will be made as to various parts of the electrophotographic image forming apparatus.

(Process Cartridge)

A process cartridge U used in the electrophotographic image forming apparatus of this embodiment contains as a unit the photosensitive drum 1 and a cleaner container 9*a* of a cleaning device 9 which function as a holder for the photosensitive drum 1. The process cartridge U is detachably mountablely supported on the main assembly 30 of the printer, and can be easily exchanged as a unit when the lifetime of the photosensitive drum 1 is reached.

The photosensitive drum 1 of the present invention comprises an aluminum cylinder having a diameter of approx. 50 mm and an organic photoconductive layer on the outside thereof, and is rotatably supported on the cleaner container 9*a* of the cleaning device 9. Around the photosensitive drum 1, there are provided a cleaning blade (cleaning means) 9*b* for removing the toner remaining on the 5 photosensitive drum 1 and primary charging means 2 for uniformly charging the surface of the photosensitive drum 1. The photosensitive drum 1 is rotated in a counterclockwise direction in the figure in accordance with the image forming operation by a driving force from a driving motor at one of the opposite ends of the drum.

(Charging Means)

The charging means 2 charges the drum through a contact charging method, wherein an electroconductive roller is contacted to the photosensitive drum 1, and the electroconductive roller is supplied with a voltage, by which the surface of the photosensitive drum 1 is uniformly charged.

(Exposure Means)

The photosensitive drum 1 is exposed to image light. More particularly, when an image signal is supplied to a laser diode, the laser diode projects image light corresponding to the image signal to the polygonal mirror 3*a*.

The polygonal mirror 3*a* is rotated at a high speed, and the image light reflected by the polygonal mirror 3*a* is selectively projected via imaging lens 3*c* and reflection mirrors 3*d* to the surface of the photosensitive drum 1 which is rotating at a constant speed so that electrostatic latent image is formed on the photosensitive drum 1.

(Developing Device)

The developing device D includes the four developing devices Dy, Dm, Dc, Db for effecting development to provide yellow, magenta, cyan and black images, respectively.

Figure 2:
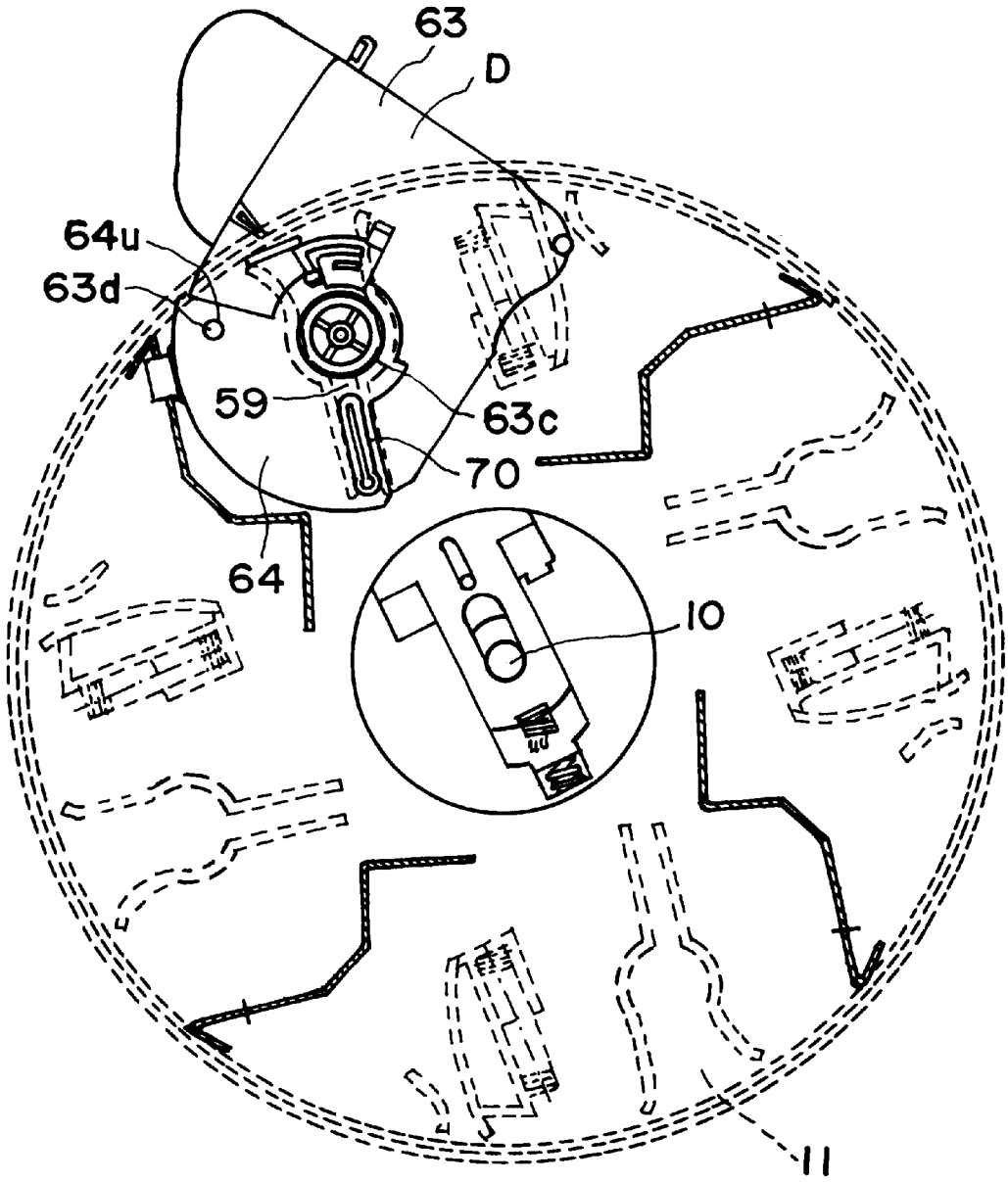
FIG. 2 is an illustration of mounting a developing device to a rotary unit of the electrophotographic image forming apparatus.
Figure 3:
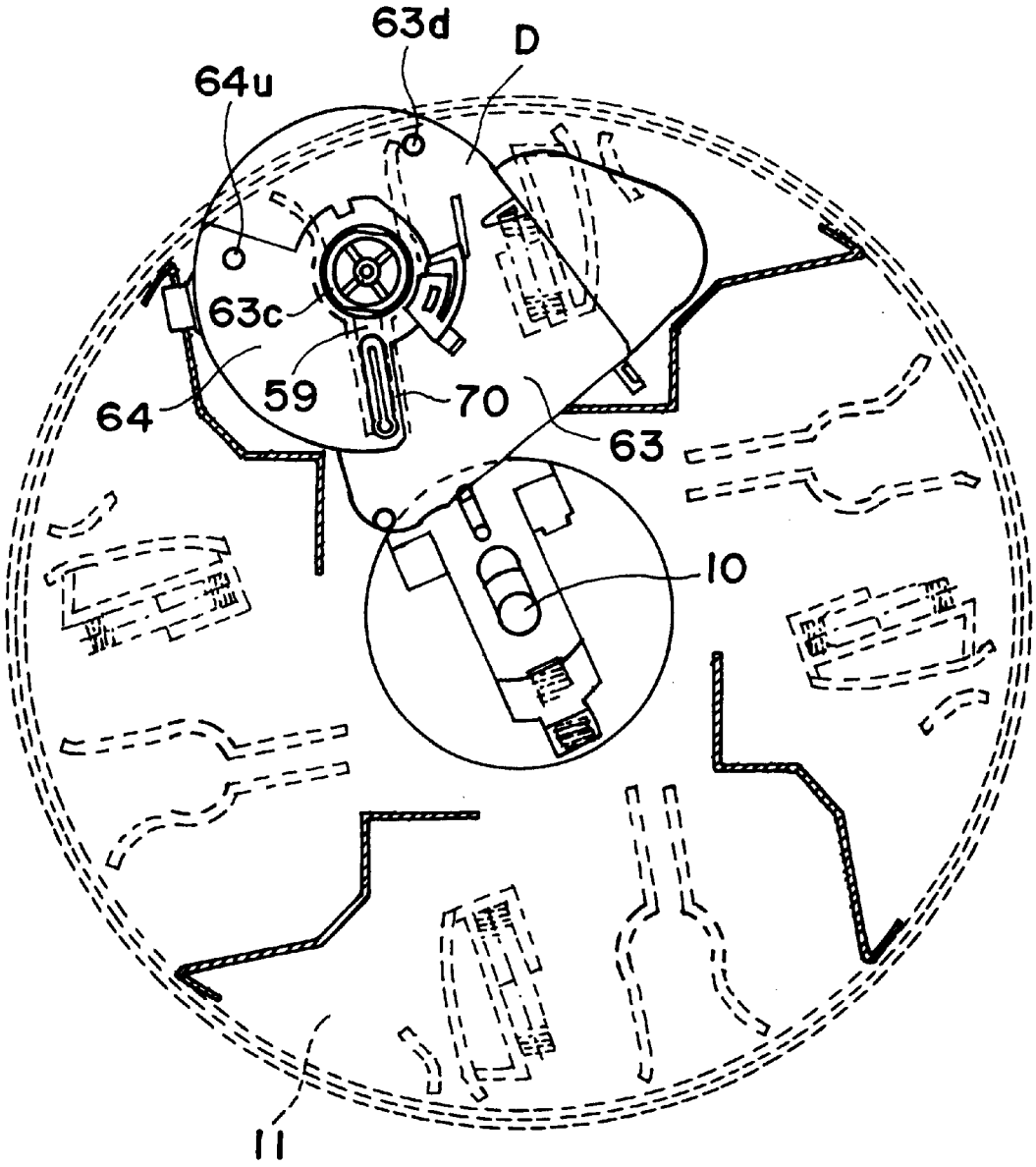
FIG. 3 is an illustration of mounting the developing device to the rotary unit of the electrophotographic image forming apparatus.

The developing devices D are detachably mountablely supported on a rotary unit 11 which rotates about a shaft 10 as shown in FIG. 1 to FIG. 3. In the image forming operation, the rotary unit 11 supporting the developing devices D rotates about the shaft 10 so as to face a predetermined one of the developing devices D to the photosensitive drum 1 and stop it there, and then the developing roller 12 as the developing means is positioned relative to the photosensitive drum 1 with a fine clearance (approx. 300 $\mu$m) therefrom, and then develops the electrostatic latent image.

During the color image formation, the rotary unit 11 rotates one full turn for one full turn of the intermediary transfer member 4, and the yellow developing device Dy, the magenta developing device Dm, the cyan developing device Dc and the black developing device Db carries out the developing process in the order named.

Figure 4:
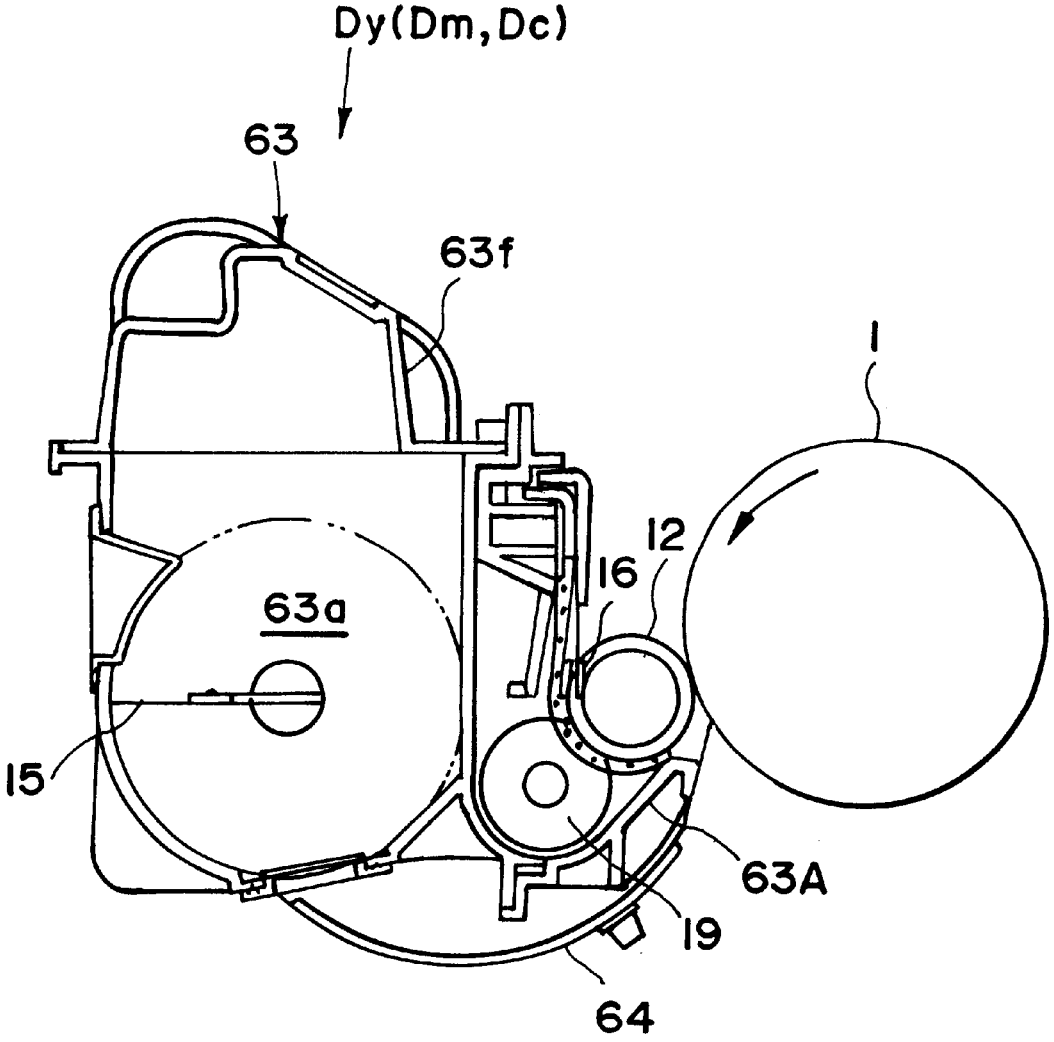
FIG. 4 is a sectional view of a major part of a yellow developing device (magenta developing device or cyan developing device) to be mounted to the electrophotographic image forming apparatus.

In FIG. 4, the yellow developing device Dy is shown as being positioned to the position facing to the process cartridge U.

The developing device Dy feeds the toner from the toner container 63*a* to the toner supplying roller 19 by a toner feeding mechanism 15, non-magnetic one component toner (developer) is applied in the form of a thin layer onto an outer periphery of a developing roller 12 rotating in a counterclockwise direction in the Figure by means of a toner supplying roller 19 rotating in the counterclockwise direction and a developing blade 16 press-contacted to the outer periphery of the cylindrical developing roller 12 (developer carrying member), during which the toner is given charge (triboelectric charge).

By applying a developing bias voltage to the developing roller 12 opposed to the photosensitive drum 1 on which the formation is formed, the toner is deposited to the photosensitive drum 1 in accordance with the latent image. The toner development is carried out for each of the magenta developing device Dm, the cyan developing device Dc and the black developing device Db through the similar mechanism.

The developing roller 12 of each of the developing devices D is connected with a driver (unshown), and a high voltage source for the color development provided in the main assembly 30 of the printer when the developing device D is rotated to the development position.

The developing roller and the electric energy supplying structure for the developing roller will be described hereinafter.

The developing device Dy, the magenta developing device Dm and the cyan developing device Dc shown in FIG. 4 have the same structure. In each of the color developing devices Dy, Dm, Dc, the toner supplying roller 19 having a peripheral surface moving in direction opposite from the moving direction of the peripheral surface of the developing roller 12 is rotatably mounted to the developing member supporting frame 63A which is a frame constituting a part of the cartridge frame 63.

Figure 5:
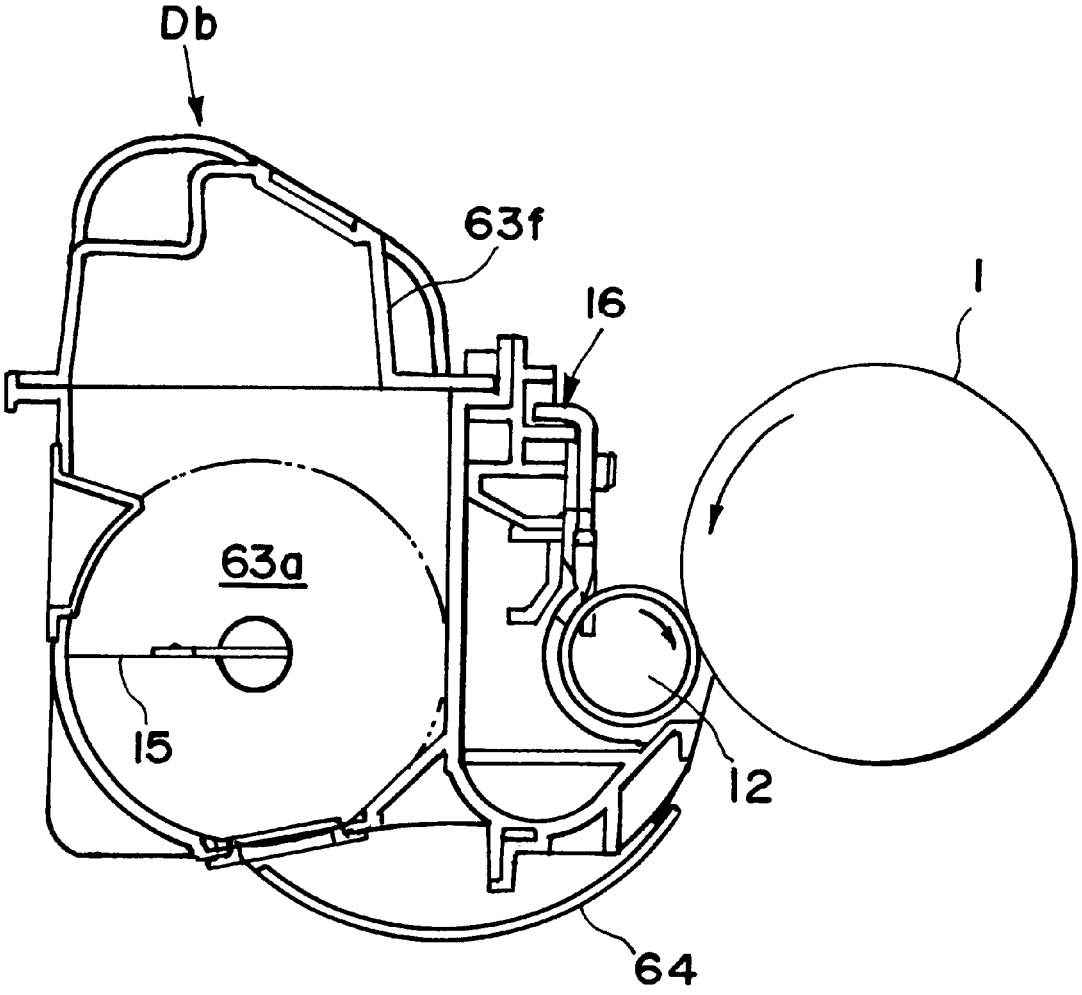
FIG. 5 is a sectional view of a major part of a black developing device to be mounted to the electrophotographic image forming apparatus.

The black developing device Db shown in FIG. 5 does not have a toner supplying roller. The toner (developer) is deposited onto the developing roller 12 by the magnetic force and depositing force, and the toner layer thickness is regulated by a developing blade 16 contacted to the peripheral surface of the developing roller 12, and also, triboelectric charge is produced on the toner.

(Intermediary Transfer Member)

The intermediary transfer member 4 functions to receive a plurality of toner image which are sequentially and superposedly transferred thereonto from the intermediary transfer member 4 (next transfer), and transfer the superposed toner images all together onto the transfer material p (next transfer). The transferring device 4 is provided with an intermediary transfer belt 4*a* which travels in the direction indicated by an arrow R4. The intermediary transfer belt 4*a* in this embodiment is extended around three rollers, namely, a driving roller 4*b*, a transfer pair roller 4*c* and a follower roller 4*d*. Adjacent the follower roller 4*d*, there is provided a confining roller. The confining roller 4*j* is movable between a position where it urges the intermediary transfer belt 4*a* to the photosensitive drum 1 and a position where the transfer belt 4*a* is away from the photosensitive drum 1. The intermediary transfer belt 4*a* travels in the direction indicated by an arrow R4 by rotation of the driving roller 4*b*. A cleaning unit 4*e* which is movable toward and away from the surface of the intermediary transfer belt 4*a* is provided at a predetermined position outside the intermediary transfer belt 4*a*. The cleaning unit 4*e* functions to remove the untransferred toner which remains on the intermediary transfer belt 4*a* after the transfer which transfers the toner images all together onto the transfer material P. The cleaning unit 4*e* brings the charging roller 4*f* into contact with the intermediary transfer belt 4*a* to apply to the toner the charge having a polarity opposite from that during the transfer operation. The toner now having the opposite polarity charge is electrostatically attracted to the photosensitive drum 1, and thereafter, is collected by means of the cleaning device g for the photosensitive drum 1 which will be described hereinafter. The cleaning method for the intermediary transfer belt 4*a* is not limited to the electrostatic cleaning, and may be a blade, a fur brush (mechanical) or the like or a combination thereof.

(Cleaning Device)

The cleaning device (cleaning means) removes the toner remaining on the photosensitive drum 1 after the transfer of the toner onto the intermediary transfer member 4, by the cleaning blade 9*b*, thus cleaning the photosensitive drum 1. The removed toner T is accumulated in the cleaner container 9*c*. The cleaner container 9*c* has such a capacity that it does not become full before the lifetime o the photosensitive drum 1, and therefore, the cleaner container 9*c* is exchanged with fresh one together with the exchange of the photosensitive drum 1.

(Sheet Feeder)

The sheet feeder 5 functions to feed the transfer material P to the image formation station, and comprises a cassette 5*a* accommodating a plurality of transfer material P, a sheet feeding roller 5*b*, a feeding roller 5*c*1, and a retarding roller 5*c*2 for double feeding prevention, a sheet feeding guide 5*g* and a registration roller 5*e*.

During the image forming operation, the sheet feeding roller 5*b* is rotated with the image forming operation to feed the transfer materials P one by one from the cassette 5*a* and guides it by the guiding plate 5*g* to the registration roller 5*e* via a feeding roller 5*c*1.

During the image forming operation, the operation of registration roller 5*e* driven in a predetermined sequences includes a non-rotation period in which the transfer material P is at rest, and a rotation period in which the transfer material P is fed to the intermediary transfer member 4, by which the image on the photosensitive member is aligned with the transfer material P for the next transfer step.

(Fixing Portion)

The fixing portion 7 fixes the toner image the toner image transferred onto the transfer material P from the intermediary transfer member 4. The fixing portion 7 comprises a fixing roller 7*a* for applying heat to the transfer material P and a pressing roller 7*b* for press-contacting the transfer material P to the fixing roller 7*a*, the rollers 7*a*, 7*b* are hollow rollers and contain therein respective heaters. One of the rollers are driven to feed the transfer material P.

The transfer material P carrying the toner image is fed by the fixing roller 7*a* and the pressing roller 7*b*, during which toner is fixed on the transfer material P by heat and pressure.

(Mounting of Developing Device to Main Assembly of the Image Forming Apparatus)

Referring to FIGS. 2 and 3, the description will be made as to mounting of the developing device.

First, an unshown switch on the main assembly 30 of the printer is depressed, in response to which the rotary unit 11 is rotated until the position thereof for the developing device D to be mounted comes to a predetermined mounting position.

Then, a cover 18 for a developing device inserting opening 17 formed in a part of the main assembly 30 of the printer, is opened. Normally, the inserting opening 17 is kept closed by the cover 18.

A guiding rib 70 provided on a side surface of a shutter 64, which will be described in detail hereinafter (FIG. 6), of the developing device D is brought into alignment with a cartridge guide 59 (FIG. 2) provided on an inner wall of the rotary unit 11 in the main assembly 30 of the printer, and then developing device D is pushed in (FIG. 3). A grip portion 63*f* (FIG. 7) provided on the cartridge frame 63 of the developing device D is pushed in the direction of an arrow shown in FIG. 2 by hand(s), by which only the cartridge frame 63 rotates while the shutter 64 is fixed on the rotary unit 11 to expose the developing roller 12, thus establishing the operable state.

(Shutter Structure)

Figure 6:
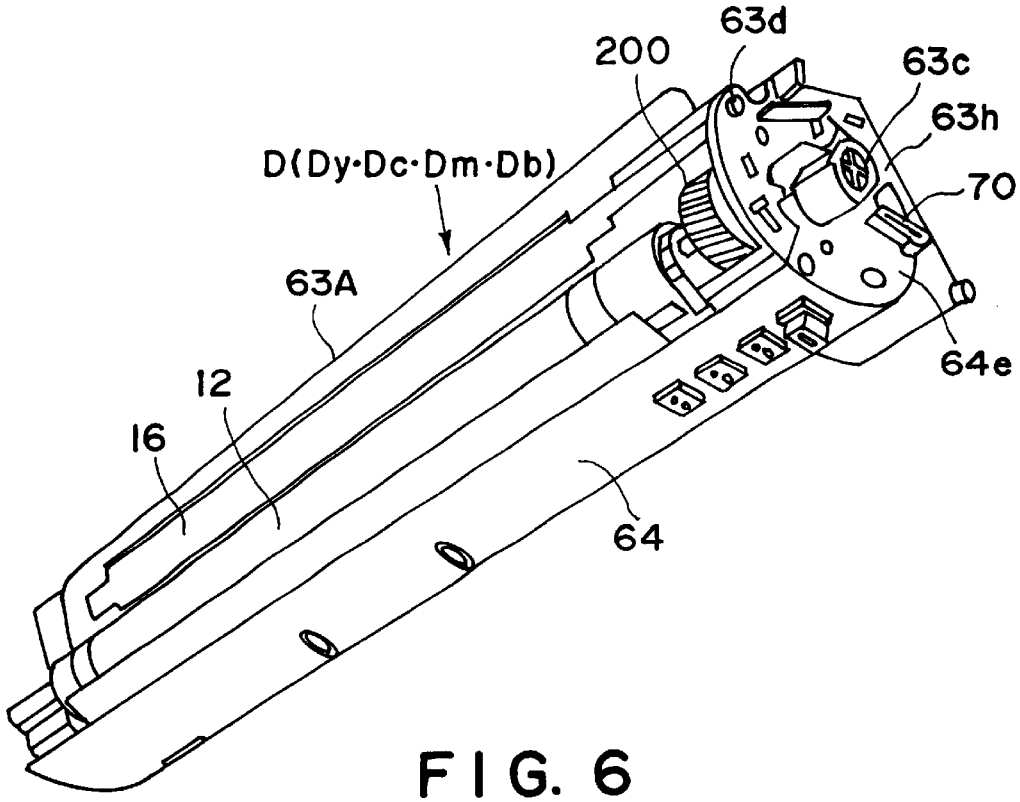
FIG. 6 is a perspective view illustrating an opening state of a shutter of a developing device.
Figure 7:
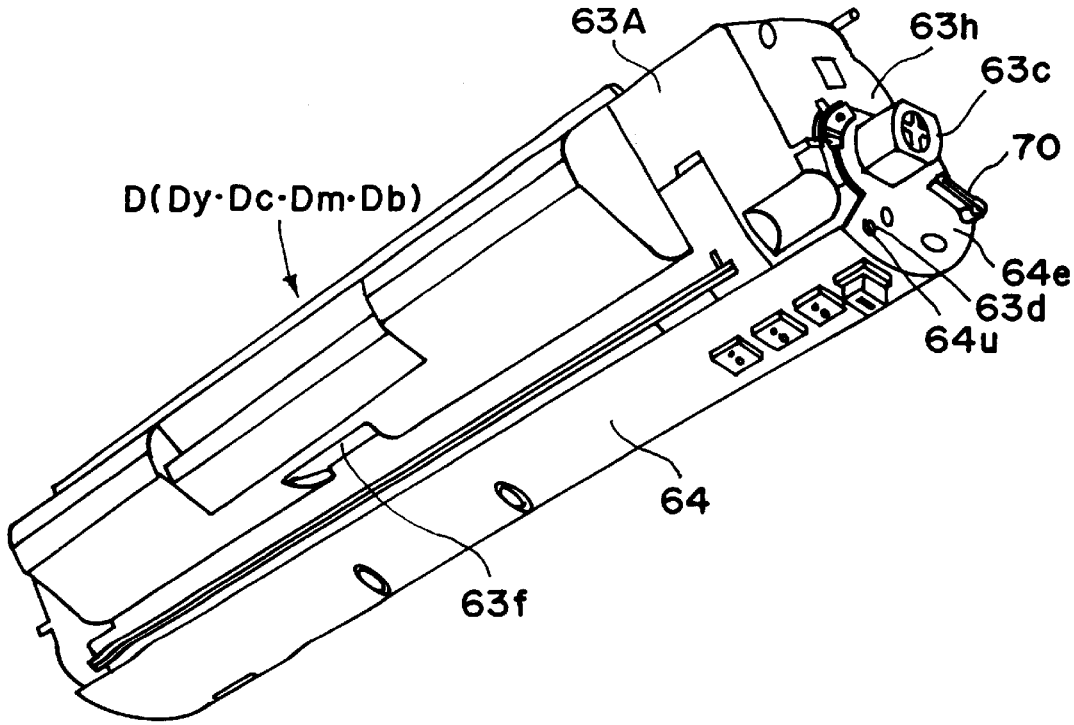
FIG. 7 is a perspective view of a developing device as seen from an opposite side of FIG. 6.
Figure 8:
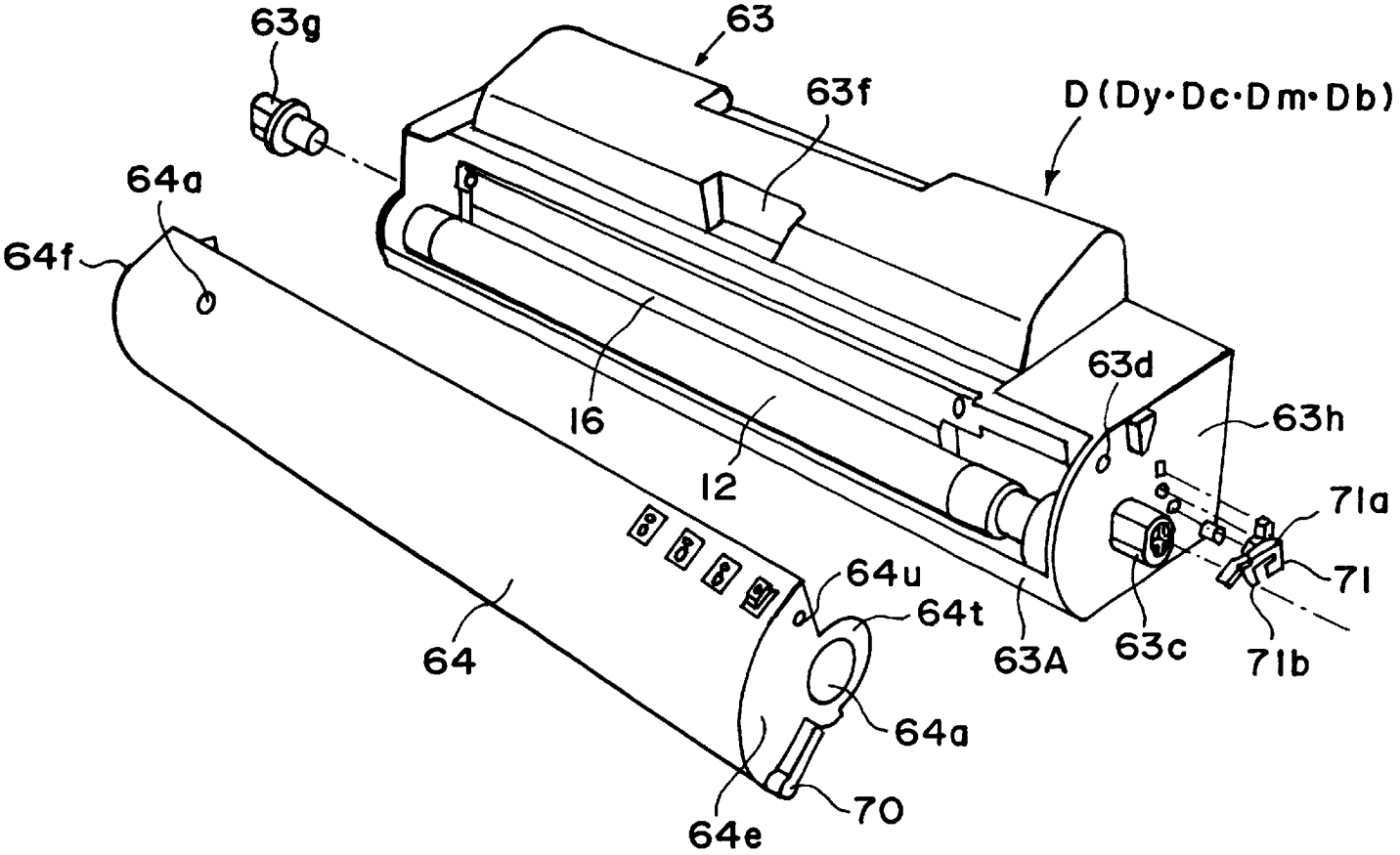
FIG. 8 is an exploded perspective view of a developing device.

Referring to FIG. 6 to FIG. 8, the shutter 64 will be described. As shown in FIG. 8, each of the longitudinal end walls 64*e*, 64*f* of the shutter 64 is provided with a round hole 64*a*, and by engagement between the round hole 64*a* and the projected portions 63*c* and, 63*g*, the shutter 64 is rotatably mounted to the cartridge frame 63. As shown in FIGS. 6, 7, the shutter 64 is movable between a position where it covers the developing roller 12 and a retracted position where the developing roller 12 is exposed, and when the developing device D is dismounted from the main assembly 30 of the printer, the shutter 64 is closed. Therefore, the developing device D is protected from dust or the like deposition and/or the damage of the developing roller 12.

Adjacent the projected portion 63*c* of the cartridge frame 63, there is a locking member 71 for locking the shutter 64 in the closed state. The locking member 71 has an engaging portion 71*b* and an arm portion 71*a* having an elasticity. On the other hand, at a predetermined position in the wall 64*e* of the shutter 64, an engaging recess 64*t* is provided for engagement. By this, when the shutter 64 is closed, said engaging portion 71*b* is engaged with the engaging recess 64*t* so that shutter 64 is locked in the closed state to prevent the shutter from being inadvertently opened.

When the developing device D is mounted to the main assembly 30 of the printer, the locking is automatically released to open.

The side wall 64*e* of the shutter 64 is provided with a round hole 64*u*, and a side wall 63*h* of the cartridge frame 63 is provided with a semi-spherical projection 63*d* correspondingly. Therefore, when the shutter 64 is in the closed state, the round hole 64*u* is engaged with the semi-spherical projection 63*d*, so that even if the locking of the shutter 64 is 20 released, the cartridge frame 63 is not rotatable relative to the shutter 64 to an unstable position.

Referring to FIG. 9 to FIG. 16, the description will be made as to the structure of the developing roller and the structure of the electric power supply contact to the developing roller.

Figure 9:
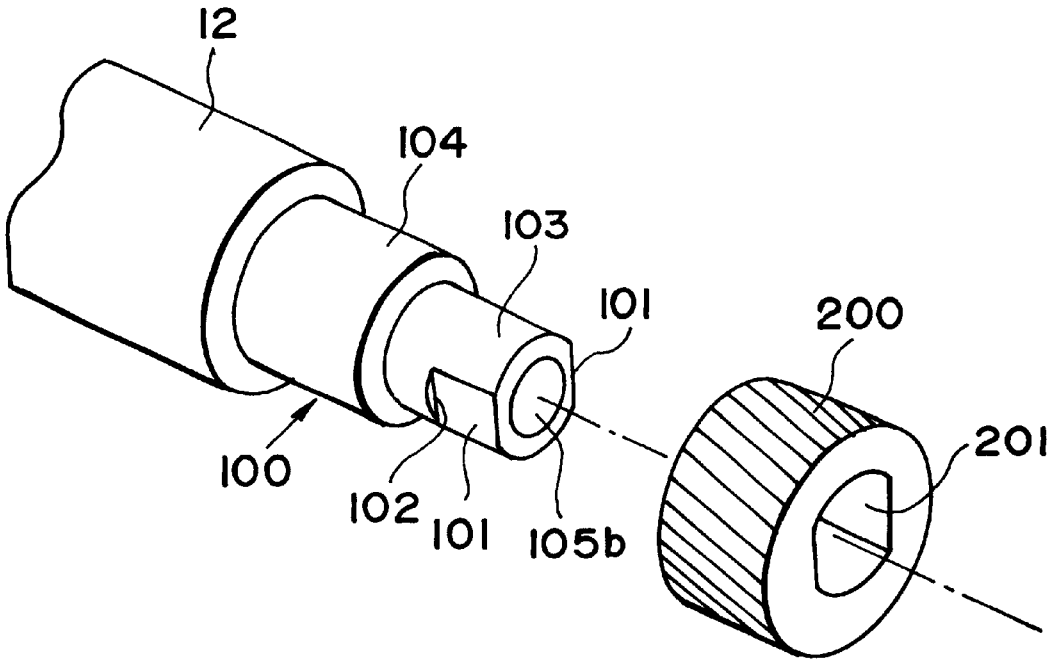
FIG. 9 is a perspective view of an outer appearance of an end surface of a developing roller.
Figure 10:
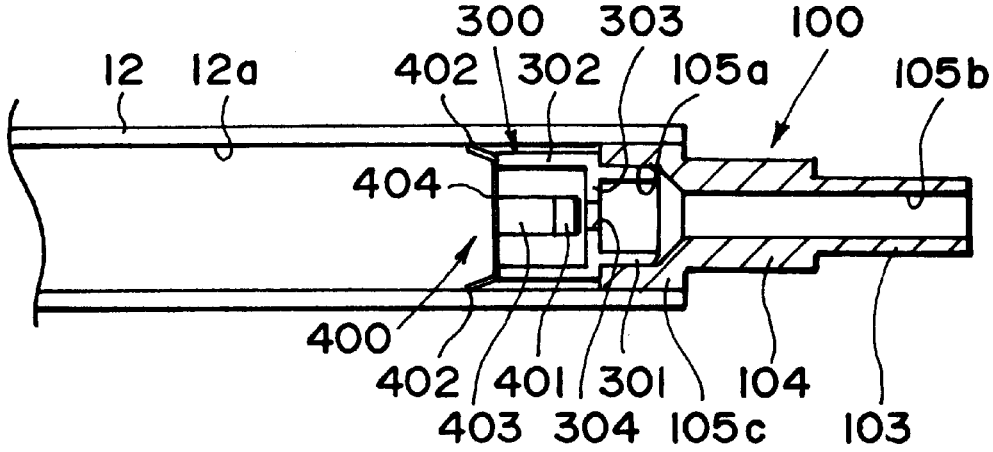
FIG. 10 is a sectional view of a developing roller.
Figure 11:
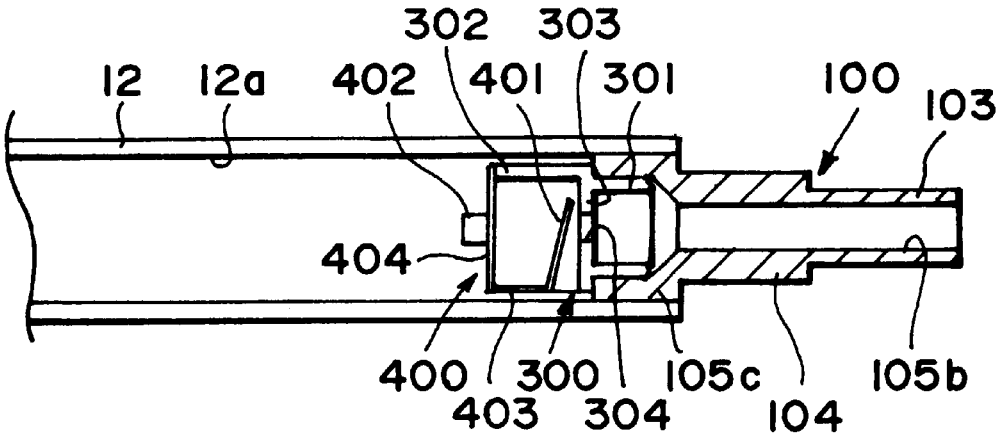
FIG. 11 is a sectional view of a developing roller taken along a direction perpendicular to a direction of FIG. 10.
Figure 12:
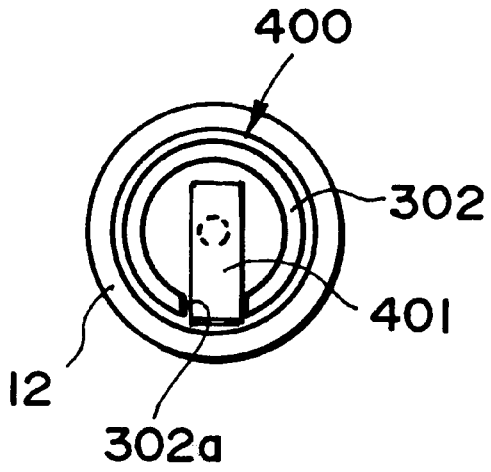
FIG. 12 is a sectional view of a developing roller taken along a line perpendicular to an axis thereof.
Figure 14:
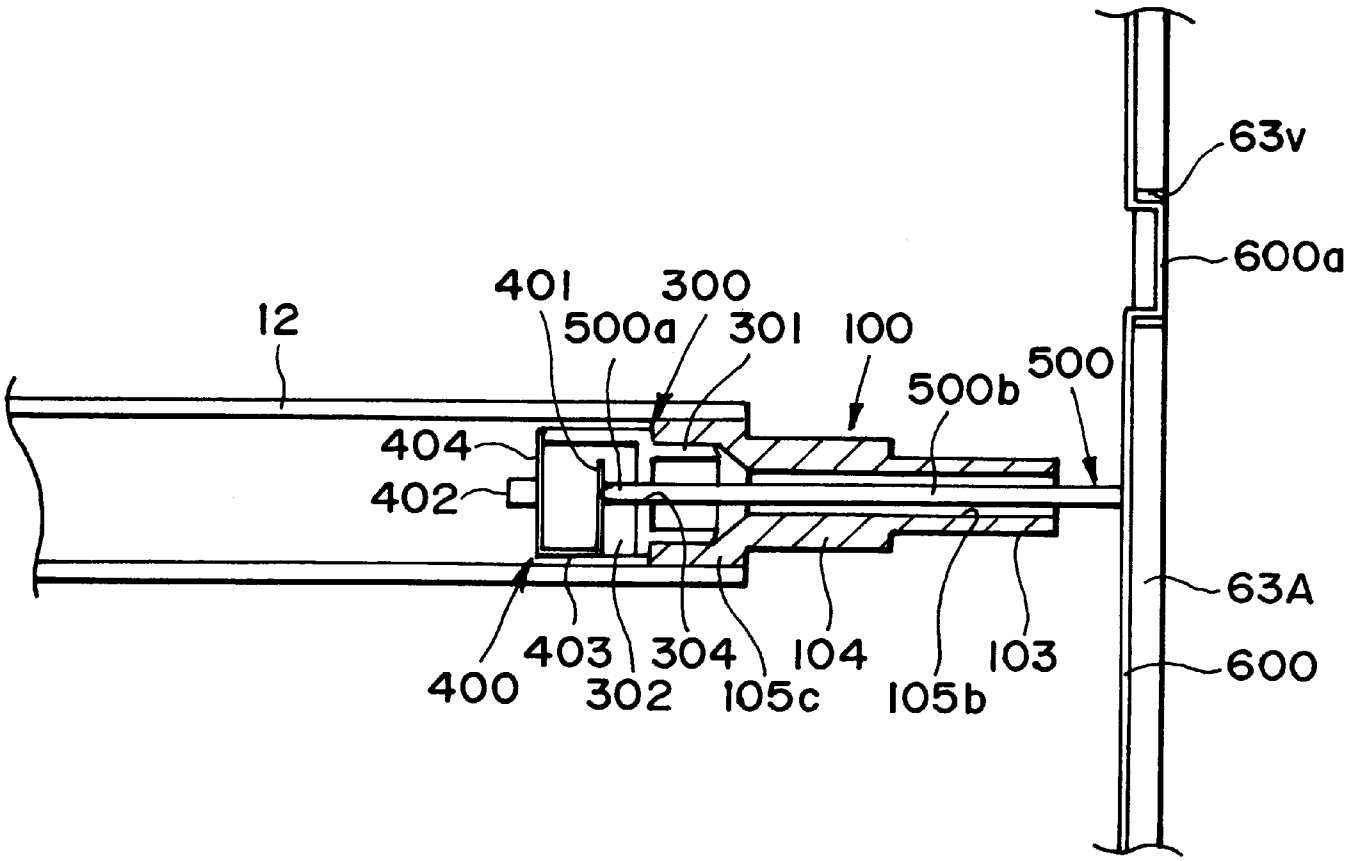
FIG. 14 is a schematic illustration of an electric energy supplying structure to the developing roller.
Figure 15:
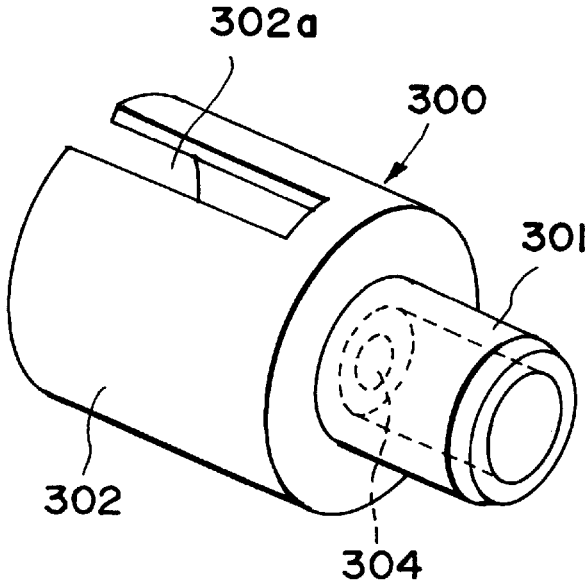
FIG. 15 is a perspective view of an outer appearance of a holder member.
Figure 16:
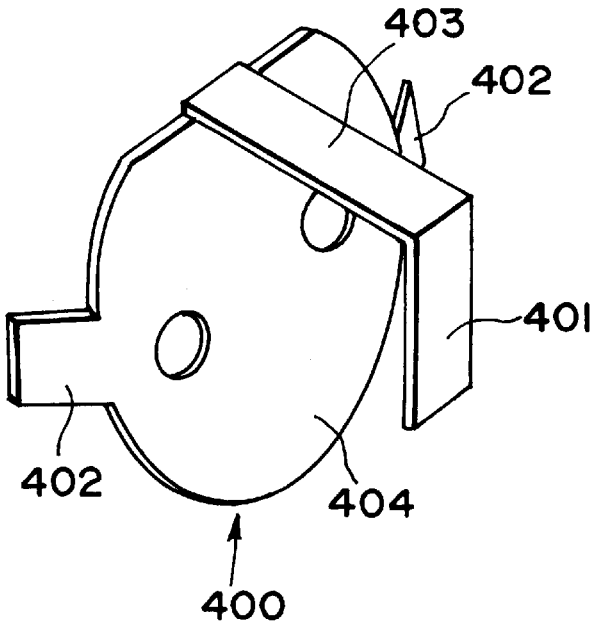
FIG. 16 is a perspective view of an outer appearance of a roller electrode plate (second electroconductive portion).
Figure 17:
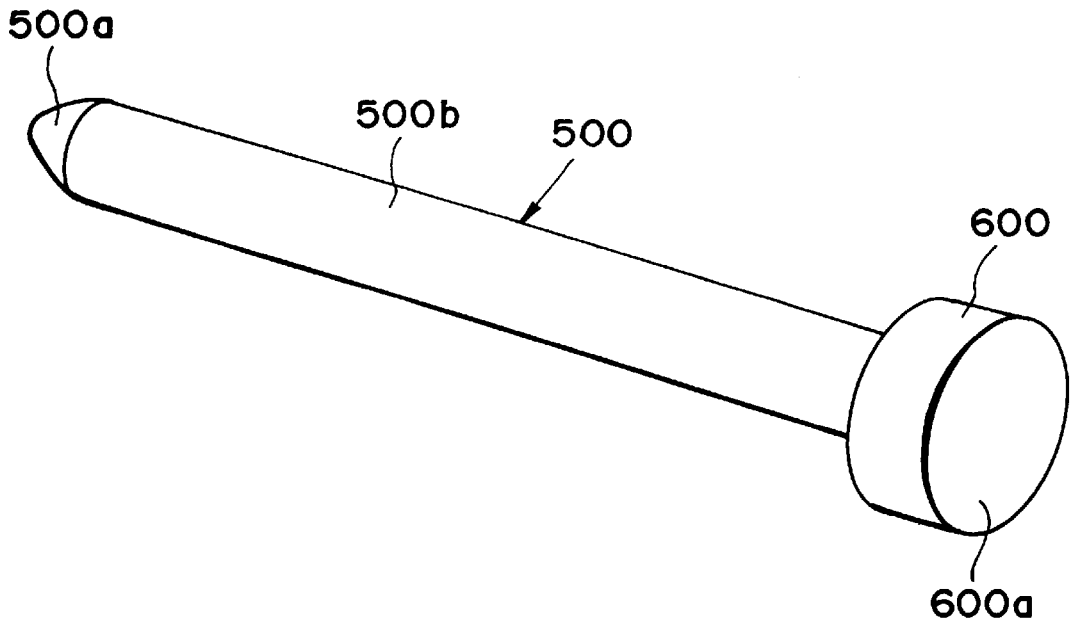
FIG. 17 is an illustration of a contact portion of a frame electrode plate (third electroconductive portion) and an electrode shaft (first electroconductive portion) which are integral, according to another embodiment of the present invention.

FIG. 9 is a perspective view of an outer appearance of an end surface of the developing roller in the embodiment; FIG. 10 is a sectional view of the developing roller; FIG. 11 is a sectional view of the developing roller taken along a perpendicular plane; FIGS. 12 the 13 is a sectional view of the developing roller taken along a perpendicular plane; FIG. 14 is a schematic illustration of an electric power supply contact for the developing roller; FIG. 15 is a perspective view of an outer appearance avoid holder member; and FIG. 16 is a perspective view of an outer appearance of a roller electrode plate which is a second electroconductive portion.

As shown in FIGS. 10 and 11, an end of a large diameter portion (first cylindrical portion) of the developing roller 12 is provided with a flange member (second cylindrical portion) 100 in the form of a shaft made of metal material such as aluminum. The outer diameter of the flange member 100 is smaller than an outer diameter of the large diameter portion. The flange member 100 has a press-fitting portion 105*c*, which is press-fitted into inner a press-fitting circumference 12*c* of the developing roller 12 so as to be non-rotatable relative to the large diameter portion of the developing roller 12. The flange member 100 of this embodiment is provided with a press-fit portion 105*c* into which the developing roller 12 is press-fitted, a mounting hole 105*a* into which an insulative holder member 300 which will be described hereinafter is press-fitted. The mounting hole 105*a* is provided radially inside of the press-fit portion 105*c* adjacent the press-fit portion 105*c*.

The flange member 100, as shown in FIG. 9, is provided with an engaging shaft portion 103 extending from a shaft portion 104 which is in turn extended axially from an end of the developing roller 12. The engaging shaft portion 103 is provided with a parallel cuts 101 and an arcuate abutment portion 102. To the engaging shaft portion 103, a drive transmitting member in the form of a gear 200 is mounted. The gear 200 is provided with an engaging hole 201 engageable with the parallel cut portions of the engaging shaft portion 103, and by the engagement therebetween, they are rotatable integrally with the developing roller 12. An abutment portion 102 of the abutment portion 102 is contacted to the developing roller 12 side surface of the gear 200 to determine the mounting position of the gear 200 to the engaging shaft portion 103.

To the other end of the developing roller 12, an unshown flange member (small diameter portion) is non-rotatably mounted to the developing roller 12 in the similar manner as with the flange member 100, and the flange member and the shaft portion 104 provided on the flange member 100 is supported by the bearing portion (unshown) provided in the developing device D.

The gear 200 is rotated by a driving source (unshown) provided in the main assembly 30 of the printer to rotate the developing roller 12.

In this embodiment, both of the flange members 100 are made of a material such as aluminum.

Therefore, the support rigidity for the developing roller 12 is improved. Accordingly, the accuracy of rotation of the developing roller 12 is improved. In this embodiment, the flange member 100 and an electrode shaft 500 (first electroconductive portion) are not contacted with each other. Therefore, the developing bias is not supplied from the flange member 100.

The description will be made as to the structure in the developing roller 12.

The flange member 100 is provided with a mounting hole 105*a* for mounting a holder member 300 which will be described hereinafter and a through hole 105*b* through which the electrode shaft 500 is penetrated, and they are arranged along an axis of the developing roller 12. The holder member 300 has a press-fit portion 301 which is press-fitted into a mounting hole 105*a* provided radially inside of the press-fit portion 105*c* of the flange member 100.

Thus, in this embodiment, the mounting hole 105*a* is formed adjacent the press-fit portion 105*c* of the flange member 100 (radially inside of the press-fit portion 105*c*), and the press-fit portion 301 of the holder member 300 is press-fitted into the mounting hole 105*a*, so that outer diameter of the press-fit portion 105*c* can be made slightly larger. By doing so, the press-fitting force between the flange member 100 of the developing roller 12 and the press-fit portion 105*c* is raised so that reliability of the fastening of the flange member 100 relative to the developing roller 12 is improved.

Figure 13:
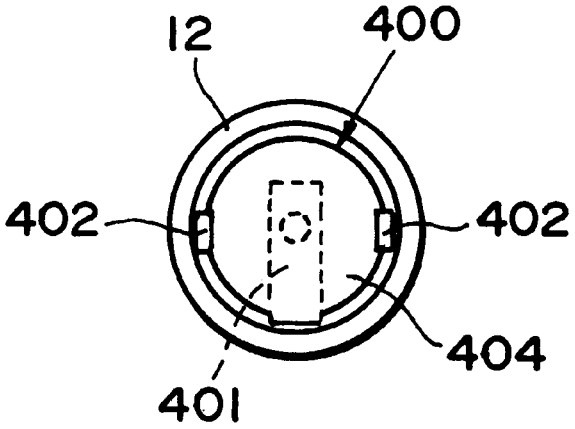
FIG. 13 is a sectional view of a developing roller taken along a line perpendicular to the axis.

The holder member 300 is provided with a cylindrical portion 302 having a diameter which is smaller than the inner diameter of the large diameter portion of the developing roller 12 and which is larger than the press-fit portion 301. To an end of the cylindrical portion 302, a second electroconductive portion (electric energy supply part) of electroconductive material (for example, a Cu alloy, Fe engagement gold such as SUS, or the like) in the form of an electrode plate (roller electrode plate) 400 is fixed. More particularly, the roller electrode plate 400 is fixed to the free end of the cylindrical portion 302 by a disk-like substrate 404 functioning as a base formed to have substantially the same outer diameter as the outer diameter of the cylindrical portion 302. The substrate 404 of the roller electrode plate 400 and the cylindrical portion 302 of the holder member 300 are fixed to each other by welding, ultrasonic welding, bonding or the like. The roller electrode plate 400 has first arm portions (first contact portions) 402 at diametrically opposite positions of the substrate 404, which are contacted to the inner surface of the large diameter portion of the developing roller 12 so as to be electrically connected. The first arm portion 402, as shown in FIGS. 10 and 16, is provided such that force is applied against a direction of removal of the holder member 300 from the flange member 100. The first arm portion 402 is disposed downstream of the base 404 with respect to the direction of the force which the second arm portion 401 receives from the first electroconductive portion 500. Therefore, the holder member 300 is prevented from separating from the flange member 100. The roller electrode plate 400 is provided with a second arm portion (second contact portion) 401 elastically contacted to the elastic of the contact portion 500*a* electrode shaft 500 which will be described hereinafter, at a radially outer end position of the substrate 404. The second arm portion is extended in a direction perpendicular to the first arm portion 402 (FIGS. 12, 13). The first arm portions 402 and the second arm portion 401 are extended in directions crossing with the substrate 404. The first arm portion 402 and the second arm portion 401 are extended in different directions. The first arm portions 402 and the second arm portion 401 are provided by bending parts of the substrates 404. The second arm portion 401 is connected to the substrate 404 through the elastic portion 403 extending in a direction parallel to the axis direction of the developing roller 12. The elastic portion 403 enters the cut-away portion 302*a* (FIGS. 12, 15), and retains such that second arm portion 401 is opposed to the engaging hole 304 which will be described hereinafter, in the cylindrical portion 302. The holder member 300 has a partition wall 303 between the press-fit portion 301 and the cylindrical portion 302, and an engaging hole 304 is formed in the partition wall 303. The engaging hole 304 is provided adjacent a position where the contact portion 500*a* of the electrode shaft 500 and the arm portion 401 of the second are contacted to each other.

On the other hand, as shown in FIG. 14, a third electroconductive portion in the form of an electrode plate (frame electrode plate) 600 is mounted to a developing member supporting frame 63A constituting a part of the cartridge frame 63. The frame electrode plate 600 is provided with a contact portion 600*a* so as to be exposed to outside through a hole portion 63*v* formed in the developing member supporting frame 63A. When the developing device D is mounted to the main assembly 30 of the printer, it is electrically connected to an electrode member (unshown) (main assembly side electroconductive portion) electrically connected to a voltage source provided in the main assembly 30 of the printer. To the frame electrode plate 600, an electrode shaft 500 (first electroconductive portion) made of circular column shaped or cylindrical electroconductive material is mounted and is electrically connected. As for a connecting method between the electrode shaft 500 and the frame electrode plate 600, crimping method, caulking method or a method in which a contact portion is provided in the frame electrode plate 600 to which an electrode shaft 500 is elastically contacted, or the like, is usable. Alternatively, an electrode shaft 500 is fastened on an unshown electroconductive member (for example, SUS plate) by crimping or the like, and the electroconductive member and the frame electrode plate 600 are electrically connected. Furthermore, the electrode shaft 500 and the contact portion 600*a* of the frame electrode plate 600 may be integrally formed, and it may be mounted to the developing member supporting frame 63A.

The electrode shaft 500 is provided at an end of the shaft portion 500*b* with a contact portion (sliding contact portion) 500*a* for electrical connection with the roller electrode plate 400. The contact portion 500*a* is preferably spherical from the standpoint of smooth sliding contact of the second arm portion 401 of the roller electrode plate 400 when the developing roller 12 is rotated. In order to minimize the wearing due to sliding motion, grease is preferentially present at the contact portion between the contact portion 500*a* and the arm portion 401.

As shown in FIG. 14, a shaft portion 500*b* of the electrode shaft 500 is penetrated through a through hole 105*b* formed in the flange member 100 with a gap from the inner surface of the through hole 105*b*, and is engaged with an engaging hole 304 provided in the holder member 300. The contact portion 500*a* is contacted by the second arm portion 401 of the electrode plate 400 with an urging force toward the frame electrode plate 600. The dimensions of the inner diameter of the engaging hole 304 and the outer diameter of the electrode shaft 500 are selected in consideration of the part accuracy and the part mounting accuracy or the like, it is preferable that with the worst value within the tolerance for the part accuracy and the mounting accuracy, the outer diameter portion of the electrode shaft and the engaging hole are relatively sliden with a small pressure. Since the outer diameter portion of the electrode shaft and the engaging hole may relatively slide, the holder member 300 is preferably made of a resin material having a good slidability such as a polyacetal resin material or the like.

When the developing device D provided with such an electric power supply contact is mounted to the main assembly 30 of the printer, the unshown electrode member of the main assembly 30 of the printer is connected to the contact portion 600*a* provided in the frame electrode plate 600 are contacted to each other, by which the developing bias can be supplied to the developing roller 12 through the frame electrode plate 600, the electrode shaft 500, the contact portion 500*a*, second arm portion 401 of the electrode plate 400, first arm portions 402 thereof.

In the developing device D provided with an electric power supply contact having such a structure, the second arm portion 401 of the roller electrode plate 400 preferably has a low spring constant since then even when the developing roller 12 moves in a longitudinal direction due to the existence of the gap between the developing roller 12 and the developing member supporting frame 63A or the like when the developing roller 12 is rotated, a proper contact pressure is maintained between the electrode shaft 500 and the contact portion 500*a*. To accomplish this, it is effective to make the elastic portion 403 (FIG. 14) between the second arm portion 401 and the first arm portion 402. In this embodiment, the second arm portion 401 is provided in the developing roller 12, the proper contact pressure can be provided between the second arm portion 401 and the contact portion 500*a* of the electrode shaft 500 without losing the longitudinal direction space of the developing device D. More particularly, it is not necessary to provide, between the developing roller 12 and the developing member supporting frame 63A, a space for permitting deflection of the second arm portion 401 to provide proper contact pressure between the second arm portion 401 and the contact portion 500*a* of the electrode shaft 500.

If the first electroconductive portion is directly slid on the inner surface of the developing roller, and the developing bias is applied, the electrical conduction at the sliding portion is not stabilized, and therefore, it is preferable to provide a second electroconductive portion on which the first electroconductive portion is slid.

In the electric power supply contact of this embodiment, the holder member 300 fixed to the inside of the developing roller 12 through the flange member 100 is provided with an engaging hole 304 for engagement with the contact portion (sliding contact portion) 500*a* of the electrode shaft 500 which slides on the second arm portion 401 of the roller electrode plate 400, and therefore, the range in which the roller electrode plate 400 and the electrode shaft 500 are contacted (sliding range) can be substantially regulated. Therefore, the contact portion 500*a* of the electrode shaft 500 is prevented from being out of place, so that reliability of the electric power supply contact is remarkably improved.

Since the sliding contact between the contact portion 500*a* of the electrode shaft 500 and the second arm portion 401 of the roller electrode plate 400 is provided in the developing roller 12, the sliding contact portion is permitted to be supplied with electroconductive lubricant such as electroconductive grease since the electroconductive lubricant does not leak to outside of the developing roller 12. Particularly, in this embodiment, the sliding contact is disposed inside of the flange member 100 in the longitudinal direction of the developing roller, so that grease is not easily leaked out.

In this embodiment, the developer is a non-magnetic one component developer, and therefore it is rather easily scattered, and therefore, the sliding contact is preferably within the developing roller.

Additionally, since the sliding contact between the contact portion 500*a* of the electrode shaft 500 and the second arm portion 401 of the roller electrode plate 400 is disposed in the holder member 300, the sliding contact, when the holder member 300 fixed to the roller electrode plate 400 is mounted to the flange member 100, is free of deformation due to external force or the like.

Furthermore, since the electrode portion or the like is not exposed to outside in the developing roller 12 per se, the handling of the developing roller per se is easy.

In the developing device of this embodiment, a holder member 300 having the contact (first arm portion 402) for contact to the inner surface of the developing roller 12 and a sliding contact (contact portion 500*a*) for contact to the electrode shaft 500, is disposed in the developing roller 12, and an engaging hole 304 for engagement with the engagement is provided adjacent the sliding contact. The holder member 300 is made of a high slidability material, and is fixed to a flange member 100 fixed to the end of the developing roller 12. The developing member supporting frame 63A of the developing device D has a contact for contact with a main assembly of the electrophotographic image forming apparatus (main assembly 30 of the printer), and the electrode shaft 500 and the sliding contact are press-contacted to apply a developing bias to the developing roller 12.

(Other Embodiments)

In the developing device D of the embodiment, the roller electrode plate 400 (second electroconductive portion) and the contact portion 500*a* of the electrode shaft 500 (first electroconductive portion) are provided at the end of the electrode shaft 500, but the present invention is not limited to this, and the outer surface of the electrode shaft 500, for example, may be contacted to the roller electrode plate 400 (second electroconductive portion). In such a case, the configuration of the first arm portion 401 provided in the roller electrode plate 400 is modified easily by one skilled in the art.

In the developing device D of the foregoing embodiments, the connecting method among the flange member 100, the developing roller 12, the flange member 100 are press-fitting, but the present invention is not limited to this, and, for example, they may be bonded by adhesive material. As regards fastening of the flange member 100 to the developing roller 12, an end of the developing roller 12 is bent and cut, and is engaged into a hole portion formed in the flange member 100.

In this embodiment, the developing device D functions to develop a multi-color image, but the present invention is not limited to this, and is applicable to a process cartridge or the like capable of forming monochromatic images.

For example, the photosensitive drum and the developing device shown in FIG. 5 are constituted into a cartridge.

Here, the process cartridge, for example, comprises an electrophotographic photosensitive member and at least one process means. As for the types of the process cartridge, there are, in addition to those disclosed hereinbefore, a type in which, for example, an electrophotographic photosensitive member, a developing means and a charging means are unified integrally into a cottage which is detachably mountable to the main assembly of the electrophotographic image forming apparatus, a type in which an electrophotographic photosensitive member and a developing means are unified integrally into a cartridge which is detachably mountable to a main assembly of apparatus, a type in which an electrophotographic photosensitive member, a developing means, a charging means and cleaning means are unified integrally into a cartridge which is detachably mountable to a main assembly of an electrophotographic image forming apparatus, a type in which an electrophotographic photosensitive member and two or more of the process means are combined integrally into a cartridge which is detachably mountable to a main assembly of an electrophotographic image forming apparatus.

The process cartridge may contain an electrophotographic photosensitive member and an at least one of charging means, developing means and cleaning means as a unit which constitutes a cartridge which is detachably mountable to a main assembly of an electrophotographic image forming apparatus. The process cartridge is mounted to or demounted from the main assembly of the apparatus by the user. This means that maintenance of the apparatus is carried out, in effect, by the user.

In the above-described, the electrophotographic photosensitive member has been described as photosensitive drum, but the electrophotographic photosensitive member is not limited to such a photosensitive drum, but the following is usable. The photosensitive member may be a photoconductor which may be an amorphous silicon, amorphous selenium, zinc oxide, titanium oxide, organic photoconductor (OPC) or the like. The photosensitive member may be in the form of a drum, a belt or another rotatable member, or a sheet, or the like. Generally, however, a drum or a belt is used, and in the case of a drum type photosensitive member, a cylinder of aluminum alloy or the like is coated with a photoconductor by evaporation or application or the like.

The structure of the charging means described in the foregoing is of a so-called contact type charging method, but a known charging means comprising a tungsten wire which is enclosed width metal shield of aluminum or the like at three sides, wherein positive or negative ions generated by application of a high voltage to said tungsten wire are directed to the surface of the photosensitive drum to uniformly charged the surface, is usable.

The charging means may be a roller type as described in the foregoing, a blade type (charging blade), a pad type, a block type, a rod type, a wire type or the like.

As for a cleaning method for removing toner remaining on the photosensitive drum, a blade, a fur brush, a magnetic brush or the like is usable. In the foregoing environment, a laser beam printer has been described in the foregoing as an example of the electrophotographic image forming apparatus, but the present invention is not limited thereto, and the present invention is applicable to an electrophotographic copying machine, a facsimile machine, a facsimile machine or the like of an electrophotographic type.

While the invention has been described with reference to the structures disclosed herein, it is not confined to the details set forth and this application is intended to cover such modifications or changes as may come within the purpose of the improvements or the scope of the following claims.

What is claimed is:

1. A developing device comprising:

a rotatable developer carrying member for carrying a developer to develop an electrostatic image formed on an image bearing member with a developer;

wherein said developer carrying member includes a first cylindrical portion and a second cylindrical portion provided at an end of the first cylindrical portion and supported by bearing portion;

a first electroconductive portion extended from an outside of said second cylindrical portion into an inside and electrically connected to an electroconductive portion outside said developing device with a gap from an inner surface of said second cylindrical portion;

a second electroconductive portion contacted to an inner surface of said first cylindrical portion and rotatable with said first cylindrical portion and slidable on said first electroconductive portion, wherein a contact portion of said second electroconductive portion relative to said first electroconductive portion urges said first electroconductive portion toward the outside of said second cylindrical portion, and wherein a developing bias is applied to the first cylindrical portion through said first and second electroconductive portion from said outside electroconductive portion of said developing device.

2. An apparatus according to claim 1, wherein further comprising a third electroconductive portion, provided in a frame of said developing device, for electrically connecting said first electroconductive portion to said outside electroconductive portion of said developing device.

3. An apparatus according to claim 1, wherein an outer diameter of said second cylindrical portion is smaller than an outer diameter of said first cylindrical portion.

4. An apparatus according to claim 1, wherein said second cylindrical portion is a flange portion fixed to said first cylindrical portion.

5. An apparatus according to claim 1, wherein said first electroconductive portion is provided with a shaft portion extended from an outside of said second cylindrical portion thereinto and having an end contacted to said second electroconductive portion.

6. An apparatus according to claim 1, wherein a sliding portion between said first electroconductive portion and said second electroconductive portion is disposed more inside than said second cylindrical portion in a longitudinal direction of said developer carrying member.

7. An apparatus according to claim 1, further comprising a holder member supporting said second electroconductive portion and fixed to an inside of said developer carrying member.

8. An apparatus according to claim 4, further comprising a holder member supporting said second electroconductive portion and fixed to an inside of said flange portion.

9. An apparatus according to claim 8, further comprising a fixing portion for fixing said flange portion and said holder member adjacent a fixed portion of said flange portion to said first cylindrical portion.

10. An apparatus according to claim 7, wherein said first electroconductive portion is provided with a shaft portion extended from an outside of said second cylindrical portion thereinto, and said supporting member is provided with an engaging hole engaged with said shaft portion adjacent a sliding portion of said first electroconductive portion and said second electroconductive portion.

11. An apparatus according to claim 7, wherein a sliding portion between said first electroconductive portion and said second electroconductive portion is provided in a holder member.

12. An apparatus according to claim 1, wherein said second electroconductive portion has a first arm portion press-contacted to said first cylindrical portion, and a second arm portion press-contacted to said first electroconductive portion, said first arm portion is disposed downstream of a base portion of said second electroconductive portion in a direction of a force which is received by said second arm portion from said first electroconductive portion.

13. An apparatus according to claim 1, wherein said developing device constitutes, together with a process cartridge detachably mountable to a main assembly of an image forming apparatus.

14. An electric energy supply part for being disposed in an electric energy supply path for applying a developing bias to a rotatable developer carrying member for carrying a developer to develop an electrostatic image formed on an image bearing member with a developer, from an outside electroconductive portion of a developing device, wherein said developer carrying member includes a first cylindrical portion and a second cylindrical portion supported by a bearing portion provided at an end of the first cylindrical portion, said electric energy supply part comprising:

a base portion;

a first contact portion connected with said base portion and contacted to an inner surface of said first cylindrical portion to electrically connect to said first cylindrical portion;

a second contact portion connected with said base portion for slidable contact with a first electroconductive portion electrically connected with said outside electroconductive portion of said developing device, wherein said second contact portion has an elasticity to urge to said first electroconductive portion.

15. An apparatus according to claim 14, wherein said first and second contact portion is bent relative to said base portion.

16. An apparatus according to claim 14, wherein said first and second contact portion are extended in a crossing direction relative to said base portion.

17. An apparatus according to claim 14, wherein said first contact portion is provided at each of two positions of said base portion, and said second contact portion is provided at a position.

18. An apparatus according to claim 14, wherein said first contact portion is disposed downstream of said base portion in a direction of a force which is received by said second contact portion from said first electroconductive portion.

* * * * *

UNITED STATES PATENT AND TRADEMARK OFFICE

CERTIFICATE OF CORRECTION

PATENT NO. : 6,366,746 B1
DATED : April 2, 2002
INVENTOR(S) : Yoshikazu Sasago et al.

It is certified that error appears in the above-identified patent and that said Letters Patent is hereby corrected as shown below:

Title page,
Item [57], ABSTRACT,
Line 5, “provi-” should read -- provided at --; and
Line 6, “sion data” should be deleted.

Column 1,
Line 10, “congressional” should read -- conventional --; and
Line 49, “a” should read -- at --.

Column 2,
Line 7, “prior art,” should read -- prior art, --.

Column 3,
Line 10, “!”longitudinal direction!” should read -- “longitudinal direction” --;
Line 19, “(General” should read -- ¶(General --; and
Line 54, “function” should read -- functions --.

Column 4,
Line 27, “mountablely” should read -- mountably --.

Column 5,
Line 23, “image” should read -- images --; and
Line 64, “σ” should read -- of --.

Column 6,
Line 62, “and,” should read -- and --.

Column 7,
Line 10, “said” should read -- the --;
Line 23, “20" should be deleted;
Line 25, “Referring” should read -- ¶(Structure of Developing Roller and Structure of Electric Power Supply Contact to Developing Roller) ¶Referring --;
Line 33, “12 the 13 is a sectional view” should read -- 12 and 13 are sectional views --;
Line 37, “avoid” should read -- of a --.
Line 47, “inner” should be deleted; and
Line 61, “a” should be deleted.

UNITED STATES PATENT AND TRADEMARK OFFICE

CERTIFICATE OF CORRECTION

PATENT NO. : 6,366,746 B1
DATED : April 2, 2002
INVENTOR(S) : Yoshikazu Sasago et al.

It is certified that error appears in the above-identified patent and that said Letters Patent is hereby corrected as shown below:

Column 10,
Line 19, “are relative sliden” should read -- can slide, the one inside the other, --; and
Line 27, “is” should read -- that is --.

Column 11,
Lines 36 and 37, “with the engagement” should be deleted.

Column 12,
Line 13, “cottage” should read -- cartridge --;
Line 29, “an” should be deleted; and
Line 53, “width” should read -- with a --.

Column 13,
Line 36, “wherein” should be deleted.

Column 14,
Line 23, “constitutes,” should read -- is constituted --.

Signed and Sealed this

First Day of October, 2002

*Attest:*

*Attesting Officer*

JAMES E. ROGAN
*Director of the United States Patent and Trademark Office*